US005334035A

United States Patent [19]

Wehrle et al.

[11] Patent Number: 5,334,035

[45] Date of Patent: Aug. 2, 1994

[54] PLUG CONNECTOR

[75] Inventors: Gerhard Wehrle, Donaueschingen; Michael Sonn, Köngen, both of Fed. Rep. of Germany

[73] Assignee: Richard Hirschmann GmbH, Fed. Rep. of Germany

[21] Appl. No.: 892,802

[22] Filed: Jun. 8, 1992

[30] Foreign Application Priority Data

Jun. 7, 1991 [DE] Fed. Rep. of Germany ..... 4118696

[51] Int. Cl.[5] ..... H01R 13/629

[52] U.S. Cl. ..... 439/252; 439/246

[58] Field of Search ..... 439/246, 252, 750, 757

[56] References Cited

U.S. PATENT DOCUMENTS

| | | | |
|---|---|---|---|
| 2,972,728 | 2/1961 | Cole | 339/64 |
| 3,242,456 | 3/1966 | Duncan | 339/64 |
| 3,614,709 | 10/1971 | Schweihs | 439/246 |

FOREIGN PATENT DOCUMENTS

| | | | |
|---|---|---|---|
| 1965782 | 8/1967 | Fed. Rep. of Germany . | |
| 2326822 | 12/1973 | Fed. Rep. of Germany . | |
| 2801090 | 7/1978 | Fed. Rep. of Germany . | |
| 3408860A1 | 9/1984 | Fed. Rep. of Germany . | |
| 411079 | 10/1966 | Switzerland . | |
| 678392 | 9/1952 | United Kingdom | 439/252 |
| 943845 | 12/1963 | United Kingdom . | |

*Primary Examiner*—Eugene F. Desmond
*Attorney, Agent, or Firm*—Robert J. Koch

[57] ABSTRACT

A plug connector may include an electrically insulated contact holder and a plug contact or contact element located in a contact chamber of the contact holder. The plug connector may be configured as a multi-pole plug connector exhibiting a plurality of contact chambers and contact elements. A plug contact or contact element may have an outwardly curving annular bead and may be configured as a bearing support with an annular groove in the contact chamber. The annular groove may be configured to complement the contour of the annular bead. The annular groove may be located in the terminal area on the connection side of a contact chamber. Alternatively, the annular groove may be located in the contact element and the annular bead may be disposed in the contact chamber. The plug connector may be manufactured without a water tight connection, if desired. A plug connector according to the invention is extremely cost effective in both the manufactured and configuration and has the advantages of a floating contact layout relative to the position tolerances of the contact elements and the manufacturing tolerances of the contact elements. The plug connector may be produced as a water tight plug connector without resorting to additional measures.

24 Claims, 2 Drawing Sheets

PLUG CONNECTOR

BACKGROUND OF INVENTION

1. Field of the Invention

The invention relates to a plug connector with an insulated contact holder and a contact element movably mounted within the contact holder. The plug connectors may be multiple pole or contact electrical connectors designed as mating plugs and sockets.

2. Description of the Related Technology

Plug connectors may be used to connect electrical contact elements. Plug connectors are advantageous as they exhibit contact elements arranged in a floating layout, such as plug sockets. Plug connectors allow one to avoid the use of "riders" of the plug pins, even when an undesirable summation of tolerances occurs.

The undesirable summation of tolerances may result from manufacturing tolerances inherent to injection molding process and shape and position tolerances of the contact holder and contact elements, which may not be avoided. Using "riders" with the plug pins on or even adjacent to the socket walls is disadvantageous and may lead to damage to and/or malfunctioning of the contact elements.

Constructive solutions are known for equalization or compensation of tolerances between the socket and the corresponding plug contacts, as shown in FIG. 1*a* through 1*c*.

FIG. 1*a* shows a known embodiment of a plug connector with a contact chamber 3 and a floating contact element 1. A shoulder 4 of the floating contact element is located in an expanded recess 2 of the contact chamber. The axial and radial dimensions of the shoulder are smaller than the dimensions of recess 2. A cover plate 5 secures contact element 1 and prevents the contact element from dropping out of the plug connector.

The contact element may include a shaft 6 located on a conduit connecting side and a plug side of the contact element. The shaft 6 passes through a bore hole 7 in cover plate 5. The internal diameter of bore hole 7 is larger than the diameter of shaft 6, as is the internal diameter of the contact chamber 3 on the plug side. Contact element 1 may be displaced in the contact holder 5, 8 in both the radial and axial directions and inclined relative to the plug axis. Large tolerances may be compensated in this manner, as a result of proper dimensions of the parts.

The plug connector may suffer from several drawbacks. The contact holder with the necessary cover plate is expensive to manufacture. Further, the cover plate must be securely fastened to the contact holder in order to withstand the contact pressure. Additionally, there are costs involved in mounting the cover plate, particularly in the case of multi-pole plug connectors, as the contact parts on the connecting side are not always in the correct position relative to the corresponding recesses in the cover plate. Another limitation in the prior configuration is that the contact is not embedded in the contact holder 5, 8 in a water tight fashion. Accordingly, this configuration has a restricted field of application.

As shown in FIG. 1*b*, locking flaps 10 are provided to secure the contact element 9. When the contact element 9 is inserted in the contact chamber 11, the locking flaps abut against the shoulder on the plug side of the collar 12. Large tolerances may also be equalized or compensated with this plug connector.

This configuration also suffers from the above-mentioned drawbacks. A disadvantage is that the contact holder 13, 14 must be formed from two parts. The requirement of stripping the parts from an injection molding machine constrains the configuration to a two-part system.

FIG. 1*c* shows an alternative plug connector including a contact chamber 16 defined by a one-piece contact holder 17. As shown in FIG. 1*c*, the contact element 15 is secured in a terminal area of the contact chamber 16 on the plug side. The contact includes a thickened segment 18 and a safety collar 19 in order to secure the element. A thin bending zone 20 enhances the mobility of the contact element 15. Even in this configuration the mobility of the contact element and thus the range of tolerance equalization is limited. Considerations such as space availability and the constant practical requirement for a low electrical resistance necessitate that the bending zone must be short and cannot be very thin.

A plug connector according to this layout requires the application of a large force to bend the contact element during the insertion process. The use of a large force may render the insertion very difficult or even impossible when the plug connector includes a large number of poles. In addition, the use of a large force results in a point shaped contact between the pin and the socket, with an associated high passage or contact resistance.

SUMMARY OF THE INVENTION

It is an object of the invention to provide a plug connector with a contact holder and a contact element, so a highly mobile contact element located in the contact chamber is assured in the simplest and most cost effective manner.

This object may be attained by providing a plug connector with an insulated contact holder exhibiting a contact chamber and a plug contact located in the contact chamber. The plug contact may have an outwardly curved annular bead supported in an annular groove disposed in the contact chamber.

The configuration of the contact element and the contact chamber may be realized simply and without additional production costs. Accordingly, production and assembly costs for a plug connector according to the invention are minimized. The contact element and the contact holder may each be a one-piece element.

The contact elements are merely pressed into the contact chambers of a multi-pole plug connector and are held in a releasable manner. The strength of this holding layout may be adapted in a very simple manner to the requirements of individual cases by the choice of the dimensions, i.e., the curved areas of the contact holder and contact element. Further, the contact chamber dimensions may be selected to permit the contact element to yield in any direction relative to the connector axis on all sides of the plug element. Thus, an optimal adaptation of position tolerances of the mutually insertable contact elements becomes possible, by choosing contact chamber dimensions in keeping with the prevailing needs of the holding layout in a very simple manner.

The contact elements yield easily, so only slight insertion forces are required even in the case of a large offset between the plug axes. In addition, to assure low passage resistances and a high contact security, there are no point shaped contacts on the socket walls. For non-water tight applications, the annular bead may be mounted in the annular groove as a floating mount. A floating mount requires no additional insertion forces, when the contact element deflects during insertion into a counter contact element not exactly axially aligned with the contact element. Advantageously, the floating mount substantially facilitates the insertion process, especially in the case of multi-pole plug connectors.

Further, the plug connector according to the invention may be made water tight, if desired. The water tight connection may be very simply and readily obtained and above all without further measures. The dimensions of the curved surfaces, the spacing of the contact elements, and the selection of a suitably elastic material for the contact holder may be made to provide a water tight connection. The contact element remains easily deflectable even with the high tightness requirements necessary for the water tight connection, i.e., a high contact pressure of the annular bead against the wall of the annular groove.

It is also within the scope of the invention to provide an alternative plug connector equivalent to the above-described plug connector according to the invention. According to the alternative embodiment, the plug connector includes an insulated contact holder exhibiting a contact chamber and a plug contact located in the contact chamber.

In contrast to the first embodiment, the alternative embodiment of the plug contact may exhibit an annular groove and may be supported in an inwardly curved annular bead of the contact chamber. The alternative embodiment is particularly suitable for configurations without excessive annular groove depths or overly thick annular beads. The alternative embodiment provides contact elements of adequate strength and the one-piece contact holder may be stripped from an injection molding without problems.

In principle all possible curvatures (contours) of the annular bead and the annular groove are feasible. According to the invention, a spherical bead with a spherical shell type configuration for the annular groove (ball bearing) provides an optimum effect. The ball bearing configuration assures a large deflection range on all sides of the contact elements in the contact chamber. The ball bearing configuration also permits the use of small dimensions with a high locking action, notwithstanding the easy insertion of the contact elements in the locked operating position.

Advantageously, the plug connector may include free-standing terminal areas of the chamber walls (dome) in the connection side, which may be slightly deformable in the radial direction. The free-standing walls allow the contact element holding power and the bearing pressure in the bearing, which affect the mobility of the contact elements, to be optimally adapted to the requirements of a particular application. For this feature an adequate choice of materials of the contact holder, the wall thickness and the length of the dome, together with the size of the abutting surfaces of the annular bead and the annular groove, is available.

The plug connector may also include a thin bending zone located on the contact element. The thin bending zone further improves the deflection of the contact element, as well as the accurate alignment of the contact element in the axial direction of the counter contact element. A thin bending zone is especially effective when the contact element and the counter contact element are strongly canted.

DETAILED DESCRIPTION OF THE PREFERRED EMBODIMENT

Figure 1A:
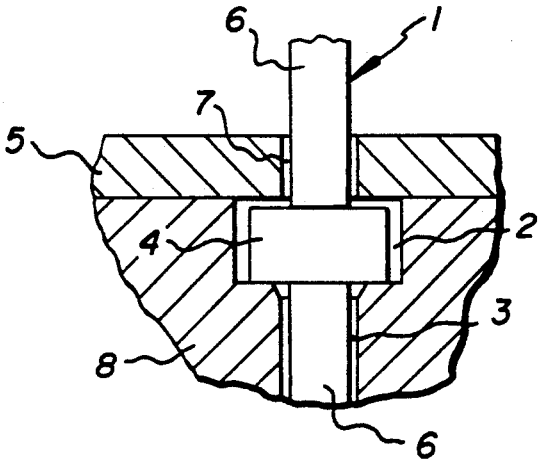
FIG. 1*a* shows a prior art plug connector.
Figure 1B:
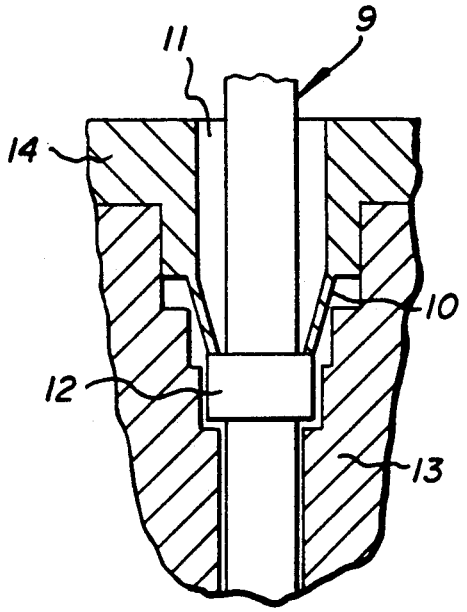
FIG. 1*b* shows another prior art plug connector.
Figure 1C:
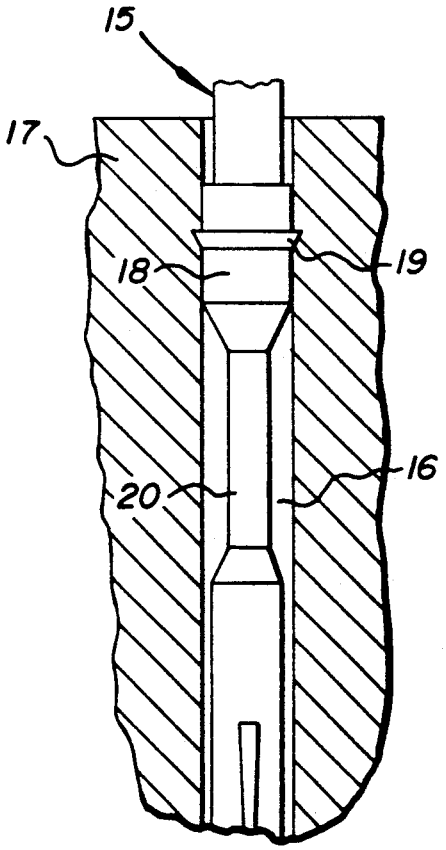
FIG. 1*c* shows a different prior art plug connector.
Figure 2:
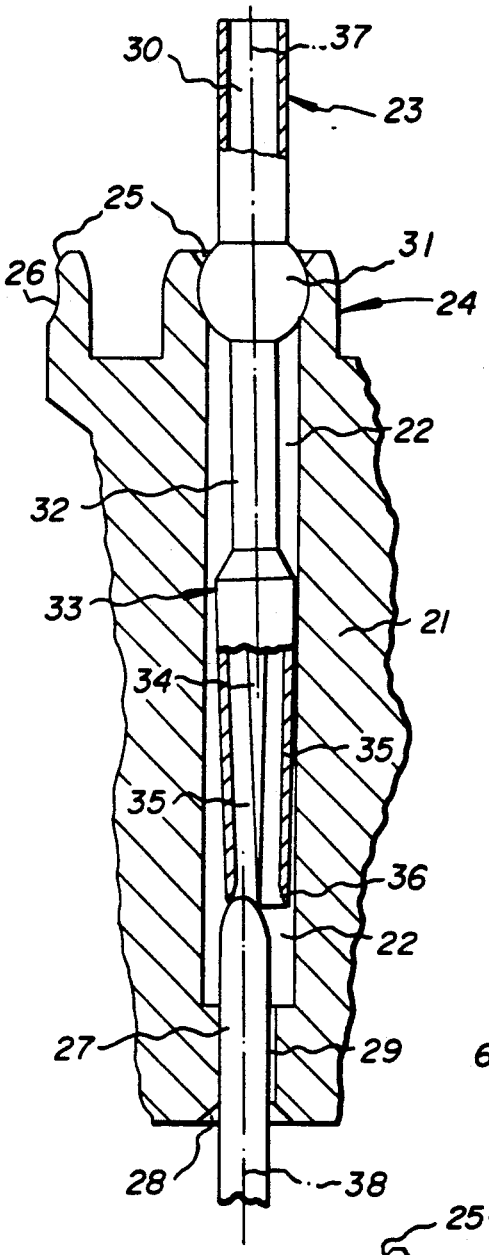
FIG. 2 shows a side view in section of a plug connector according to the invention through a contact holder area of a 20-pole connector with a contact chamber and the contact element inserted therein.

FIG. 2 shows a plug connector according to the invention. A contact holder 21 may be located in a plug connector housing (not shown) and may include a plurality of contact chambers 22. A contact bushing 23 may be introduced into contact chamber 22 from the cable connection side and releasably locked in the contact chamber. The terminal areas on the connection side of the contact chamber 22 may define a free-standing dome 24. One end of the dome 24 may include an insertion funnel 25 and an annular groove 26 with a spherical shell shaped contour adjacent the insertion funnel.

The terminal areas on the plug side of the contact chamber 22 may include a lead-in bevel 28 for the secure insertion of a connector pin 27. The connector pin may have a rounded tip. The terminal areas may also define a tapered segment 29 adjacent to the lead-in bevel for the coarse centering of connector pin 27. The contact bushing 23 may include a tubular cable connection part 30 for the soldering of the insulated end of a cable strand, a spherical annular groove 31 and a thin bending part 32.

The contact bushing may also include a tip jack or plug bushing 33 formed from hemispherical shells 35 defining a funnel shaped receptor 36 located at their free ends and separated by a longitudinal slit 34.

In view of the one-piece contact holder 21, the plug connector mounting merely requires introducing the contact bushing 23 into the contact chamber 22 until a spherical snap-in connection results, i.e., the spherical annular bead 31 locks into the annular groove 26 with its fitted spherical shell contour. The manufacture of the plug connector is, therefore, highly cost effective.

In the assembled plug connector, the spherical annular bead 31 may be located in the spherical shell shaped annular groove 26 and freely pivot in all directions. Consequently, the contact bushing 23 may also be deflected from its axial position. The range of deflection and the maximum plug axis offset between the contact bushing 23 and the plug pin 27 that can be equalized may be determined very simply by the dimensions of contact chamber 22.

The layout of the bearing 26, 31 at the terminal area of the contact chamber 22 on the connection side results in a relatively small angle between the bushing axis 37 and the pin axis 38 even in the case of a large deflection. The plug connector configuration, which results in the small angle between axes 37, 38 reduces the insertion force required. The insertion force is further reduced by thin bending part 32. In the case of unaligned axes 37, 38 the thin bending zone 32 acts to further diminish the aforementioned angle, i.e., to align the plug bushing 33 in the direction of the axis 38 of the plug or connector pin 27.

FIG. 2 also shows the maximum possible offset of the two plug contact axes 37, 38. During insertion the plug pin 27 is initially guided along the upper edge of the tapered segment 29 of the contact chamber 22. The rounded tip of the plug or connector pin then slides into a funnel shaped receptor 36 of the plug bushing 33.

The plug bushing 33 is brought into a position aligned with the plug pin 27, upon deflection, i.e., the rotation of the contact bushing 23 in the bearing 26, 31 and additionally by the slight bending of the bending part 32. This configuration, which practically corresponds entirely to a floating layout, effectively avoids the use of "riders," and permits the use of very low insertion forces, which is a highly important advantage, especially for multi-pole plug connectors.

The contact holder material, the length and wall thickness of the dome 24, the size of the abutting bearing surfaces and the diameter of the annular bead 31 must be chosen carefully. Optimally, the contact bushings 23 may be easily inserted. Further, an adequate pull-off force of the contact bushings 23 is assured, as the contact bushings are locked the contact holder in a releasable manner, without special structures, i.e., locking flaps.

Additionally, it is possible to determine with these parameters, the pressure whereby the annular bead 31 abuts against the spherical shell shaped surface of the annular groove 26. If no water tightness is required, this pressure can be reduced to zero by the appropriate selection of the aforementioned parameters, so that the insertion forces are very low. For example, the axial and radial dimensions of the annular groove 26 should exceed the axial and radial dimensions of the spherical annular bead 31. The insertion forces will only depend on the necessary contact pressure applied by the prestressed hemispherical shells 35 of the plug bushings to the plug pin 27 during insertion. That configuration is, therefore, highly suitable for multi-pole plug connections.

On the other hand, a water tight plug connection may be attained by the suitable choice of the aforementioned parameters to provide an extended pressure range. For example, the radial and axial dimensions of the spherical annular bead 31 should match or slightly exceed the radial and axial dimensions of the annular groove 26.

Figure 3:
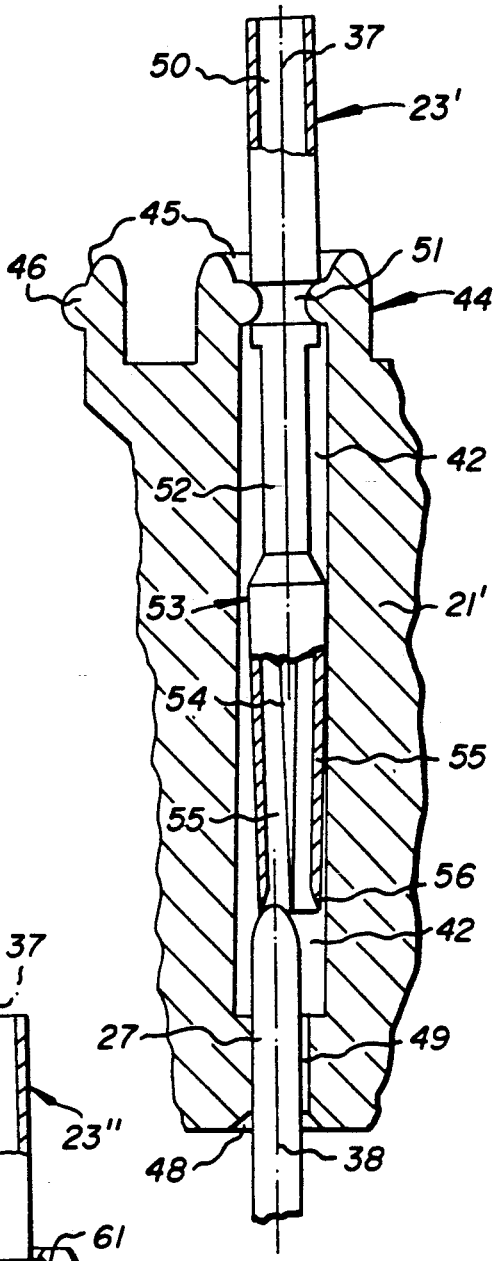
FIG. 3 shows a side view in section of another embodiment of a plug connector according to the invention.

FIG. 3 shows a second embodiment of a plug connector according to the invention. The alternative embodiment of the plug connector is similar to the first embodiment, and includes an insulated contact holder 21' exhibiting a contact chamber 42 with a lead-in bevel 48 and a tapered segment 49. A plug contact 23' may be located in the contact chamber. The alternative plug contact may also exhibit a tubular cable connection part 50, a thin bending section 52 and a tapered plug bushing 53. A pair of hemispherical shells 55 may form the tapered plug bushing, which may exhibit a longitudinal slot 54 and a funnel-shaped receptor 56.

In contrast to the first embodiment, the alternative plug contact 23' may exhibit an annular groove 51 and may be supported in an inwardly curved annular bead 46 disposed in the contact chamber. The alternative embodiment is particularly suitable for configurations without excessive annular groove depths or overly thick annular beads. In this configuration, adequate contact element strength may be obtained and the one-piece contact holder may still be stripped from an injection molding machine without problems. A free standing dome 44 defining an insertion funnel 45 may also be provided.

Figure 4:
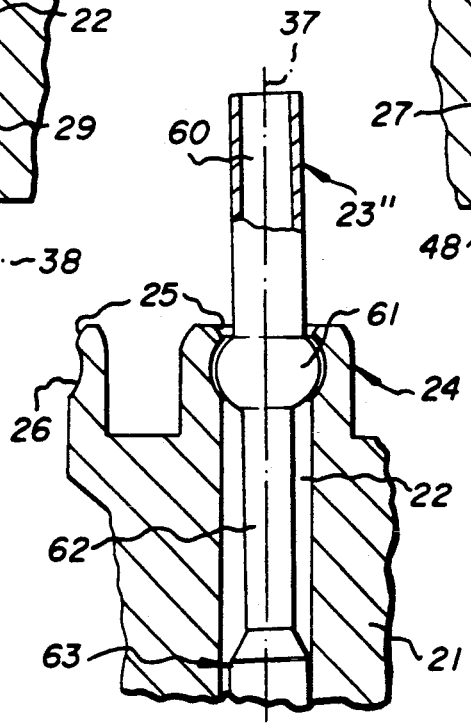
FIG. 4 shows a side view in section of another embodiment of a plug connector according to the invention.

FIG. 4 shows a third embodiment of a plug connector according to the invention. In the third embodiment the contact holder 21 and contact chamber 22 are identical to the first embodiment, thus a discussion of those elements has been omitted. In contrast to the first embodiment, FIG. 4 shows a plug connector that does not have a water tight connection. Contact element 23" preferably exhibits a tubular cable connection part 60, a thin bending section 62 and a tapered plug bushing 33. A pair of hemispherical shells may form the tapered plug bushing, which may exhibit a longitudinal slot (not shown) and a funnel-shaped receptor (not shown).

According to the third embodiment, contact element 23" may also exhibit a preferably spherical annular bead 61 with a first radius of curvature. Contact chamber 21 may also exhibit a preferably spherical shell-type annular groove 26 with a second radius of curvature. In contrast to the first embodiment, the radius of curvature of annular bead 61 is less than the radius of curvature of annular groove 26 resulting in a floating connection which is not water tight.

In summary, utilization of a plug connector holder and support according to the invention results in a plug connector that is extremely cost effective both in its configuration and assembly. Further, the plug connector has all of the advantages of a floating contact element layout and may be water tight without additional measures, if necessary. These advantages are particularly apparent in the case of multi-pole connectors and are of great importance, especially for mass produced commodities such as plug connectors.

This contact/contact holder configuration may be used for plug-pin contacts as well as receptacle-pin contacts.

The illustrated embodiments are shown by way of example. The spirit and scope of the invention is not to be restricted by the preferred embodiment shown.

What is claimed is:

1. A connector comprising:

a contact holder exhibiting a contact chamber and a slightly deformable free-standing wall defining a portion of said contact chamber; and a contact located in said contact holder contact chamber and exhibiting a curved bead supported in a groove in said contact chamber.

2. A connector according to claim 1, wherein said curved bead is spherical and said groove defines a spherical shell.

3. A connector according to claim 1, wherein said contact exhibits a thin bending section.

4. A connector according to claim 1, wherein said contact exhibits a bushing.

5. A connector according to claim 4, wherein said contact bushing exhibits a tapered opening.

6. A connector according to claim 4, wherein said contact bushing exhibits a tapered section and is connected to a thin bending section.

7. A connector according to claim 4, wherein said contact bushing exhibits a tapered section configured to define a slot.

8. A connector according to claim 1, wherein said contact curved bead exhibits a radius of curvature and said contact chamber groove is a curved groove exhibiting a radius of curvature.

9. A connector according to claim 8, wherein the radius of curvature of said contact curved bead is equal to the radius of curvature of said-contact chamber curved groove.

10. A connector according to claim 8, wherein the radius of curvature of said contact curved bead is less than the radius of curvature of said contact chamber curved groove.

11. A connector according to claim 1, wherein said connector is a multi-pole connector exhibiting a plurality of contact chambers, each of said contact chambers supporting one of a plurality of contacts.

12. A connector comprising:

an electrically insulated contact holder exhibiting a contact chamber; and a contact pivotally mounted in said contact holder contact chamber and exhibiting a groove; said contact chamber exhibiting a beaded bearing contacting said contact groove and supporting said contact.

13. A connector according to claim 12, wherein said contact groove is a curved groove exhibiting a radius of curvature and said contact chamber beaded bearing is a curved beaded bearing exhibiting a radius of curvature.

14. A connector according to claim 13, wherein the radius of curvature of said contact curved groove is equal to the radius of curvature of said contact chamber curved beaded bearing.

15. A connector according to claim 13, wherein said contact curved groove is configured to match a contour of said contact chamber curved beaded bearing.

16. A connector according to claim 12, wherein said contact holder exhibits a free-standing wall defining a portion of said contact chamber.

17. A connector comprising:

a contact holder exhibiting a contact chamber; and a contact element located in said contact holder contact chamber and movably supported by said contact holder, said contact element exhibiting a bushing located at an end of said contact element, and a bending section having a cross-section less than a cross-section of said bushing, said contact holder and said contact element defining a ball bearing connection.

18. A connector according to claim 17, wherein said contact holder exhibits a free-standing wall defining a portion of said contact chamber.

19. A connector according to claim 17, wherein said contact chamber exhibits an annular groove.

20. A connector according to claim 17, wherein said contact element exhibits an outwardly curved annular bead.

21. A connector according to claim 20, wherein said contact chamber exhibits an annular groove configured to match a contour of said curved annular bead.

22. A connector according to claim 17, wherein said contact element further exhibits:

a tubular cable connection part;

a ball-shaped bead connected to said connection part;

said bending section connected to said ball-shaped bead; and said bushing connected to said ball-shaped bead and exhibiting a slot and a tapered opening.

23. A connector according to claim 17, wherein said contact element exhibits a curved member with a radius of curvature and said contact chamber exhibits a curved groove with a radius of curvature.

24. A connector according to claim 23, wherein the radius of curvature of said curved member is less than the radius of curvature of said curved groove.

* * * * *